United States Patent [19]

Pacitti

[11] 4,104,745

[45] Aug. 8, 1978

[54] SOFA BED WITH TV HEADREST

[76] Inventor: William Pacitti, Monroe, Mich.

[21] Appl. No.: 771,909

[22] Filed: Feb. 25, 1977

[51] Int. Cl.[2] ..... A47C 17/14

[52] U.S. Cl. ..... 5/13; 5/29; 5/57 D

[58] Field of Search ..... 5/13, 17, 28–30, 5/57 R, 57 D

[56] References Cited

U.S. PATENT DOCUMENTS

| | | | |
|---|---|---|---|
| 3,298,041 | 1/1967 | Rogers | 5/13 |
| 3,516,096 | 6/1970 | Mikos | 5/13 |
| 3,710,402 | 1/1973 | Eakins | 5/13 |
| 3,984,883 | 10/1976 | Wong | 5/13 |

*Primary Examiner*—Casmir A. Nunberg

*Attorney, Agent, or Firm*—Harness, Dickey and Pierce

[57] ABSTRACT

A sofa bed frame has a storage area in the bottom below the front board which receives the folded sections of the bed unit when containing a mattress which is folded within the sections. A rear TV section is pivoted to a rear bottom section which is pivoted to a vertical intermediate section which has a front top section pivoted thereto. When the four sections are open, they extend above the front sofa board and are in planar relation to each other with the TV rear head section operable to be raised to an approximate 45° angle at which an occupant can view television, read a book or the like. The television rear head section has a pair of links which move into aligned relation when the sections are being folded to raise the TV rear head section to an approximate 90° position so that it may be advanced into the area of the back to require a minimum of storage space below the sealing position of the sofa bed.

12 Claims, 10 Drawing Figures

Fig. 9.
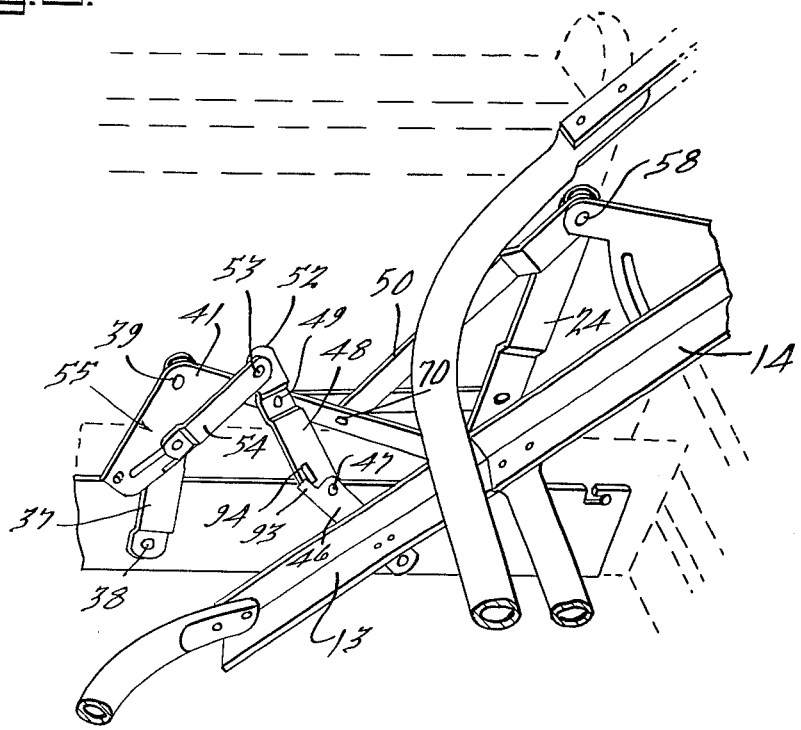
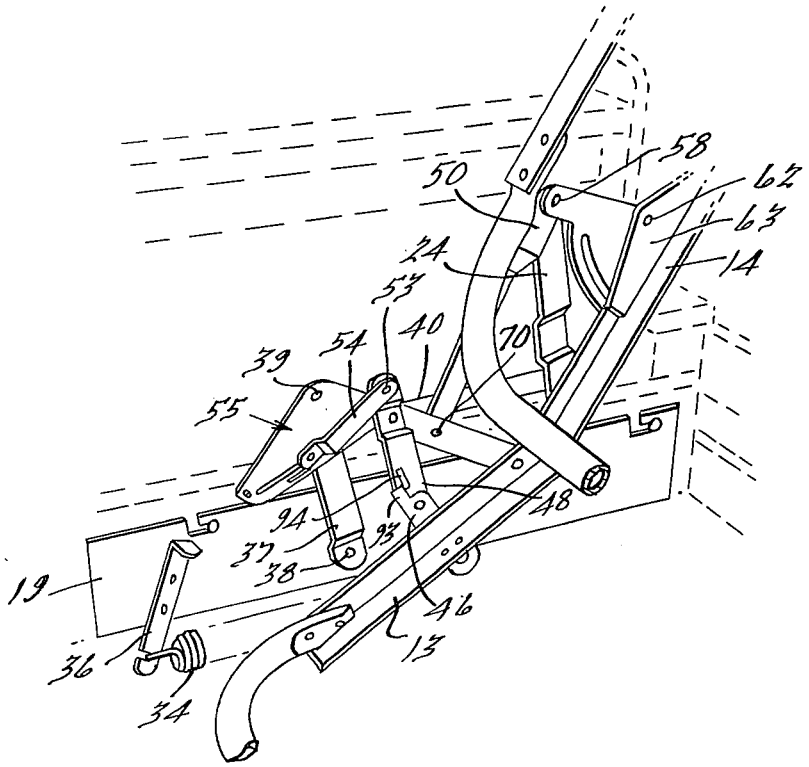
Fig. 10.

SOFA BED WITH TV HEADREST

BACKGROUND OF THE INVENTION

Reference may be had to U.S. Pat. Nos. 1,095,465; 1,216,443; 1,295,840 to show television headrests forming the rear section of the foldable bed unit as well as U.S. Pat. No. 2,691,708 which discloses an extra angularly positionable frame; U.S. Pat. No. 2,748,398 discloses a head section pivoted to the sofa which is also true of U.S. Pat. Nos. 3,516,096 and 3,710,402 which disclose a TV rear head section which may be tilted at an angle to the planar bed sections.

SUMMARY OF THE INVENTION

The sofa bed embodies a sofa bed frame and a plurality of bed frame sections which fold into an assembly which swings within a storage space at the bottom and back of the sofa bed frame. The plurality of bed sections include a TV head section pivoted to a rear bottom section which is pivoted to a vertical intermediate section which has a front top section pivoted thereto. When in bed relationship, the four sections are in planar relation and when in storable relation to each other the TV rear head section is disposed vertically within the back section. The rear bottom section extends horizontally at the bottom of the storage area, a vertical intermediate section is disposed adjacent to the front cross board of the sofa while the front top section folds over the rear bottom section at or below the top of the front sofa board with a mattress folded therebetween. The rear bottom bed section is supported at the rear end on a pair of pivoted arms which permits the vertical intermediate section to be rocked above the sofa front board and pulled forwardly thereover to have a pair of legs on the rear bottom section move to a right angle position to form a front support therefor. The front top section and the vertical intermediate section are then swung upwardly and forwardly in planar relation to each other and to the rear bottom section and the TV rear head section. A second pair of legs on the front top section opens outwardly and extends downwardly to engage the floor for supporting the front end of the section.

When folding the sections to have them placed within the sofa bed storage area, the legs again fold into parallel relation to the front top and rear bottom sections. A pair of links which are pivoted together has one end pivoted to a bracket on the TV rear head section and the other end pivoted to the operating mechanism. The links move into aligned operable relation and start to raise the TV rear head section so that it will advance into the back recess and be in substantially right angle relation to the rear bottom bed section.

When the sections are in bed planar relation, the TV rear head section may be raised from planar position with the other section to a substantially right angle position and moved back to have a latch mechanism retain the head section at an approximate 45° angle. When it is desired to have the TV rear head section again moved to planar relation with the other bed sections, it is moved to substantially right angle position to release the latch and permit the section to move back to planar relation with the bed sections.

BRIEF DESCRIPTION OF THE DRAWINGS

FIG. 9 is a view of the pair of hinged links which is pivotally connected to the TV rear head section shown in alignement with the rear bottom section when the bed sections are being folded, and FIG. 10 is a view of the structure illustrated in FIG. 9, after the rear bottom section has been swung upwardly and rearwardly to start the movement of the TV rear head section to a right angle position to the rear bottom section so as to be in a substantially vertical position when stored in the back frame recess, as illustrated in FIG. 4.

DESCRIPTION OF THE PREFERRED EMBODIMENT

Figures 1, 2, 3:
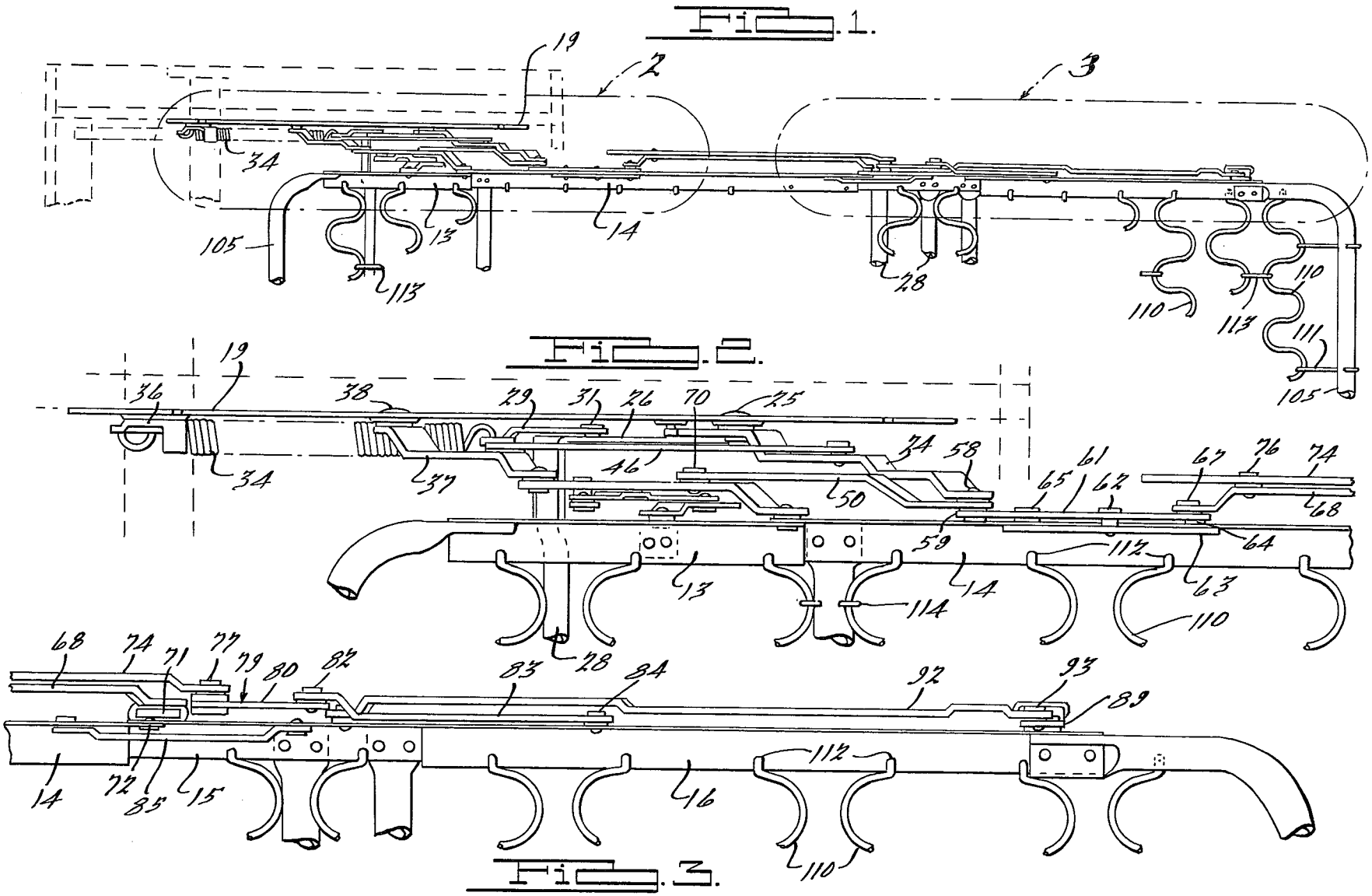
FIG. 1 is a broken plan view of the lefthand side of a sofa bed embodying features of the present invention.
FIG. 2 is an enlarged, broken view of the lefthand portion of the structure illustrated in FIG. 1.
FIG. 3 is an enlarged, broken view of the righthand portion of the structure illustrated in FIG. 1.

The sofa frame 11, herein illustrated in dash line, supports a bed unit 12 which is composed of four hinged sections which may be compactly folded and disposed within a storage area 17 within the bottom of the sofa frame 11 below the top of a front board 18 thereof. A TV rear head section 13 is pivoted to the rear of a rear bottom section 14 which is pivoted to the rear of a vertical intermediate section 15 to which a front top section 16 is pivotally secured. The bed frame storage area 17 is provided within the bottom of the sofa frame into which the folded bed sections are stored. Plates 19 are secured to the opposite ends of the sofa frame against the inside surface of the arm areas where they are releasably secured by the engagement of the bolt 21 within L-shaped slots 22 in the top ends of the plates. The entire folded bed unit and mechanism may be removed from the storage area 17 by loosening the bolts 21 and sliding the plates 19 forwardly to release them from the sides after a plurality of retaining screws 23 have been removed.

Figure 8:
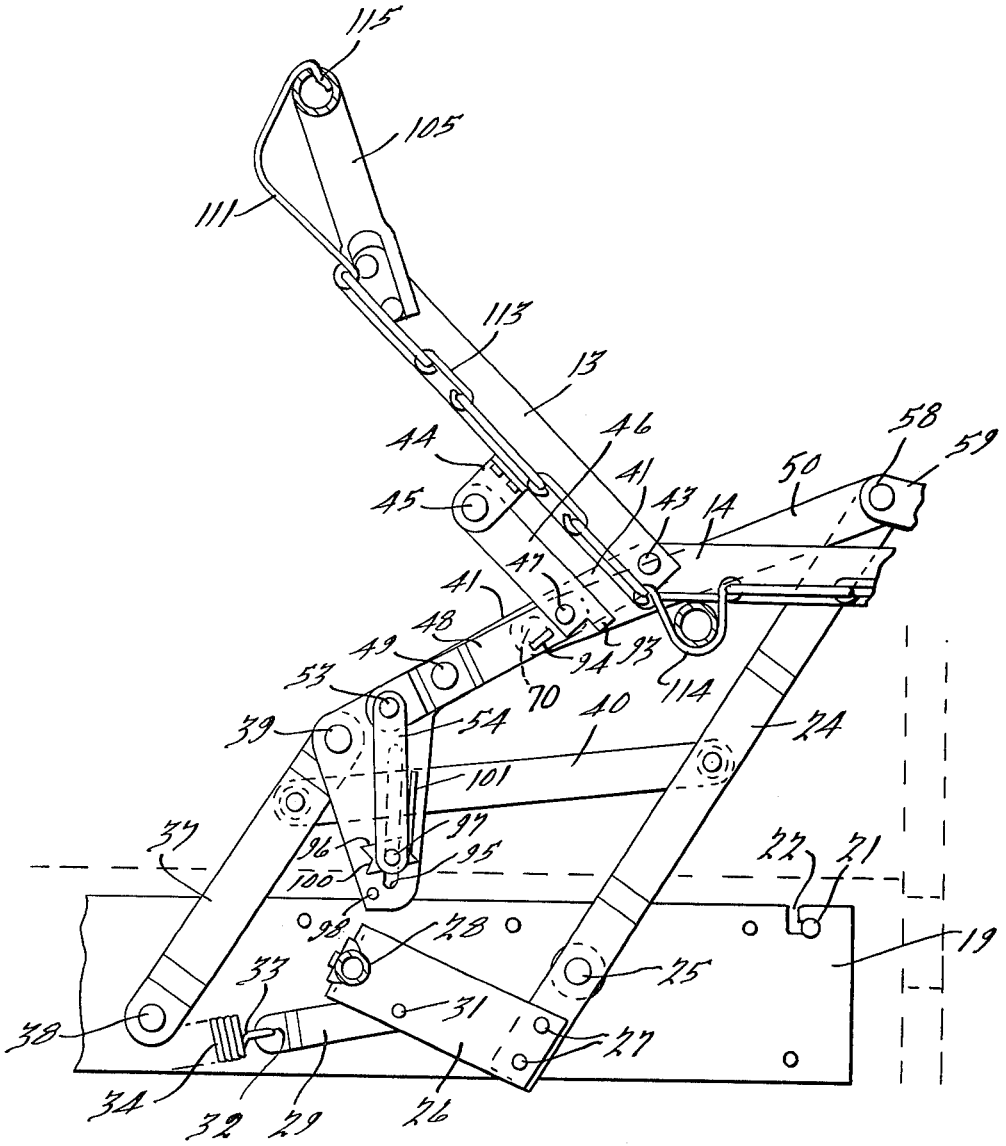
FIG. 8 is an enlarged view of the TV rear head section of the bed unit when supported in angular TV viewing position.

The plates 19 have an arm 24 secured thereto on a pivot 25 with a plate 26 extending rearwardly approximately at right angles thereto, secured in position by rivets 27. A cross bar 28 joins the ends of the spaced plates 26 to provide stability thereto. A line 29 is secured by a pivot 31 to the plate 26, the opposite end having an aperture 32 in which a hook 33 of a coil spring 34 is secured. A hook 35 on the opposite end of the coil spring 34 is secured within a notch on the end of an arm 36 attached to the plate 19 by rivets 30. The tension of the spring 34 assists in the folding and storage of the sections of the bed frame unit. A link 37 is secured to the plate 19 on a pivot 38 and, as illustrated in FIG. 8, is shown in substantially parallel relation to the arm 24 to which it is connected by a link 40. The end of the link 37 is secured to the angular corner of a bell-crank line 41 by a pivot 39. The link 40 interconnects the arm 24 and the link 37 in parallelogram relation to the pivots 25 and 38 to have them operate in substantially parallel relation to each other.

The bell-crank line 41 has its upper end secured to a pivot 43 which connects the TV headrest section 13 to the rear bottom section 14 at the adjacent ends thereof. The TV rear head section 13 has a bracket 44 riveted thereto to extend downwardly therefrom and is connected by a pivot 45 to a link 46. The link 46 is secured by a pivot 47 to a link 48 which is secured intermediate its length by a pivot 49 to the arm 51 of the bell-crank link 41. The extending end 52 of the link 48 is secured by a pivot 53 to a link 54. The link 54 has a releasable securing mechanism 55 operated thereby which will be described in detail hereinafter.

Figure 4:
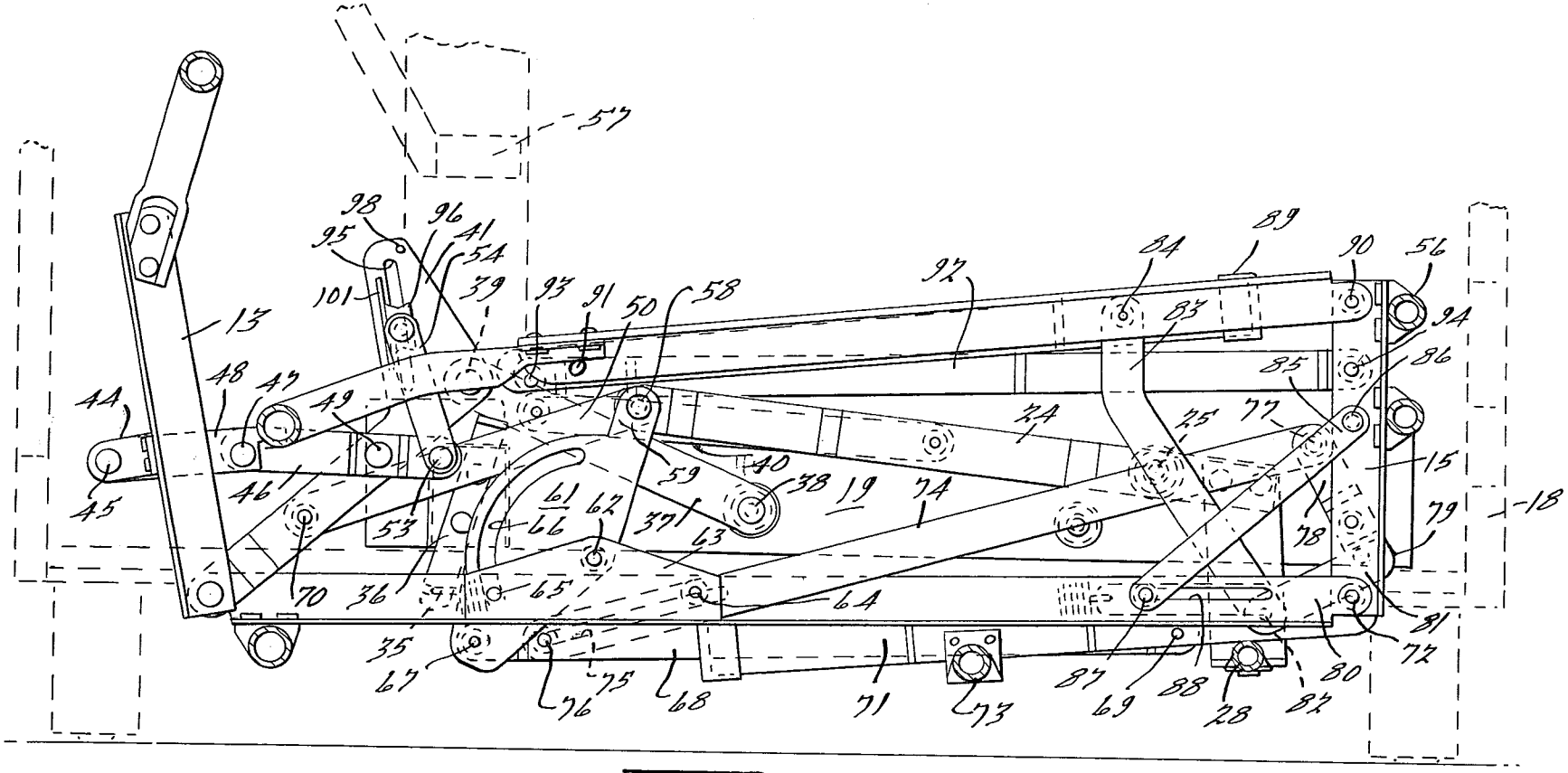
FIG. 4 is a view of the sections of the bed frame illustrated in FIG. 1, with the bed sections folded into a position for storage within the storage area of the sofa which is illustrated in dash lines.

Referring more particularly to FIG. 4 which shows the bed sections 13, 14, 15 and 16 in folded stored position, the grasping and lifting of the tubular cross member 56 rocks the foldable structure counter-clockwise substantially about the pivot 39 and moves the front top section 16 to about a 60° position and the TV headrest section toward a horizontal position beneath the back rail 57. This raises the front end of the bottom frame section 14 above the front board 18 of the sofa frame. Further upward and outward movement occurs on the link 37 and arm 24 which swing clockwise in unison through the interconnection by the link 40 and the link 50 which has its ends secured to the pivot 58 and to the arm 51 of the bellcrank link 41 by a pivot 70. The pivot 58 on the outer end of the arm 24 is connected to an end 59 of a swing plate 61. The swing plate 61 is connected by a pivot 62 to a plate 63 which is secured to the rear bottom bed section 14 by rivets 64 and 65. The rivet 65 extends through an arcuate slot 66 in the swing plate 61. The opposite end of the swing plate 61 from the end 59 is secured by a pivot 67 to a link 68 the opposite end of which is secured by a pivot 69 to a supporting leg 71. The leg 71 is secured to a pivot 72 which interconnects the forward end of the rear bottom bed section 14 to the vertical section 15. When the sections 14, 15 and 16 are swung forwardly over the top of the front board 18, the leg 71 is pivoted forwardly to be disposed downward in alignment with the vertical intermediate section 15. A tubular cross member 73 interconnects the two legs 71 so as to stabilize them when engaging the floor. A link 74 has a slot 75 through which a pivot 76 secured to the link 68 extends. The opposite end of the link 74 is secured by a pivot 77 to an arm 78 of a bellcrank 79 which is secured by a pivot 81 to the vertical intermediate section 15. The other arm 80 of the bellcrank 79 has its end secured by a pivot 82 to a link 83 which has its forward end secured by a pivot 84 to the front top section 16 of the bed unit.

A link 85 is pivoted to the vertical section 15 by a pivot 86, the opposite end of the link 85 has a pivot 87 secured thereto which slides within a slot 88 disposed within the rear bottom section 14. The pivot 87 moves within the slot 88 during the pivoting of the vertical bed section 15 relative to the rear bottom bed section 14. The plate 61 which has its end supported on the arm 24 swings in a counterclockwise direction when the bed sections are moved to planar position. This moves the TV head section and the rear bottom section into horizontal position supported on the pair of legs 71. The raising of the front top section pivots the vertical section on the rear bottom section to be in planar relation therewith moving the pivot 87 in the rearward end of the link 85 forwardly in the slot 88 to move the link 85 to horizontal position. During the movement of the folded bed sections onto the legs 71 the link 74 is ineffective and no movement of the bellcrank 79 occurs. A leg 89 is secured by a pivot 91 to the forward end of the top bed section 16 which has an adjacent end secured to a link 92 by a pivot 93. The rear end of the link 92 is secured by a pivot 94 to the vertical bed section 15, as illustrated in FIG. 4. The swinging of the front bed section to horizontal position has the link 92 operate the leg 89 into vertical position for supporting the forward edge of the front bed section 16. The pivot 93 is below the pivot 91 and out of alignment with the pivots 93 and 94 to have the link operable to swing the leg 89 to vertical position, as illustrated in FIG. 4.

The bellcrank 79 and links 74 and 85 lock the sections 14, 15 and 16 in the position illustrated in FIG. 4 for compressing the mattress which is folded between the top section 16 and bottom section 14 and retains it in seating position within the sofa frame. When the vertical and top sections 15 and 16 are swung outwardly on the pivots 72 and 90 at the ends of the vertical intermediate section 15, the lock formed by the bellcrank 79 and link 85 is released and all of the bed sections 13, 14, 15 and 16 are moved into a horizontal plane. After the four sections are swung to horizontal bed position, the bed sections may be folded by swing the front bed section to a vertical position and then to a horizontal position swinging the vertical section into vertical position in which relation the links 74 and 85 and bellcrank 79 lock the top and bottom sections 14 and 16 from separating. The raising of the vertical section 15 swings the sections 14 and 16 therewith into an approximate 45° angle returning the legs 71 against the rear bottom section 14. The links 46 and 48 are moved into aligned relation with the finger 93, which extends beyond the pivot 47, engaging the projection 94 and prevents the pivot 47 from moving to over-toggle position relative to the pivots 46 and 49, as illustrated more specifically in FIG. 10.

As the two sections 14 and 16 are swung downwardly toward the rear of the storage area 19 in the sofa frame, the links 93 and 94 swing the TV rear head section to an angular position relative to the bed section 14. As the plate 61 is pivoted by the arm 24 and link 50, the links 46 and 48, in extension of each other, swing the TV rear head section to right angle position relative to the rear bottom bed section 14. The TV bed section 13 is moved upwardly into the back area beneath and behind the cross member 57 to assume a substantially vertical position, as illustrated in FIG. 4. This shortens the length of the two sections 14 and 16 so as to have seating portion of the sofa from the front to the back as small as possible. When swinging the folded bed sections out of the storage area 19, the links 46 and 48 permit the TV rear head section 13 to swing counterclockwise into a position in planar relation with the rear bottom section 14. As the folded bed sections are raised from the storage area 19 of the sofa frame, the legs 71 are moved to a vertical position parallel with the vertical section 15. The swinging of the front top section 16 upward and forwardly first swings the vertical section 15 to horizontal position with the other bed sections. Further movement of the front bed section 16 moves it into horizontal position on the front legs 89 aligned with the vertical, rear and TV head sections. The mattress which rests upon the bed sections is not herein illustrated, but will fold between the sections when the sections are moved into the position illustrated in FIG. 4 in locked relation to each other.

When in planar position, the TV rear head section 13 may be raised to its stored position, as illustrated in FIG. 4, at substantially right angles to the bed section 14 and then moved counterclockwise substantially 45° to have the releasable locking mechanism 55 retain the TV head section 13 at an angle of approximately 45° for reading, viewing television and the like, thereafter the section 13 may be raised to vertical position to have the holding mechanism released to permit the rear head section 13 to be moved downwardly into parallel relation with the other bed sections. While the releasable mechanism may take many forms, such as those employed on chests, cabinets and the like for raising the lid and thereafter releasing the lid to close the chest or cabinet, the mechanism 55 herein illustrated embodies a slot 95 in the bellcrank link 41 with the link 54 having a star wheel 96 secured thereto by a pivot 97. When the bed section 13 is hinged clockwise, the link 48 pivots counterclockwise moving the pivot 53 and the link 54 downwardly thereby having the side of the angular recess 100 at the end of the star wheel 96 engage a pin 98 at the bottom of the slot 95 to cause the star wheel 96 to rotate into locked position. The star wheel 96 swings clockwise into a locked position to retain the bed section 13 at a 45° angle as illustrated in FIG. 8, when the star wheel moves into engagement with the bottom end of the rib 101. The raising of the bed section 13 to a vertical position thereafter lowers the star wheel 96 to permit it to again strike the pin 98 to have it swing clockwise against the rib 101, into vertical position, to permit its pivot 97 to move upwardly in the slot 95 as the bed section 13 is lowered into planar relation to the other bed sections 14, 15 and 16.

With this arrangement, the forward ends of the bottom and top sections 14 and 16 are supported on legs which are moved to vertical position as the sections are unfolded into bed relation. When all of the sections are in aligned horizontal position, the TV rear head section 13 may be raised to a 45° position and retained until released and again moved to horizontal bed position. The folding of the four bed sections into a compact storage until which is supported on a link 37 and arm 24 at the rear end permit them to be swung into the sofa storage area. A pair of pivotally joined links which are pivoted to the rear bed section 13 and to an actuating link, positively raises the TV rear head section into 90° relationship with the adjacent bed section 14 so that it can be moved into the back area for compact storage. The three sections 14, 15 and 16 are locked in storage position to form a seating area aligned with or below the top of the front board of the sofa frame.

Figure 5:
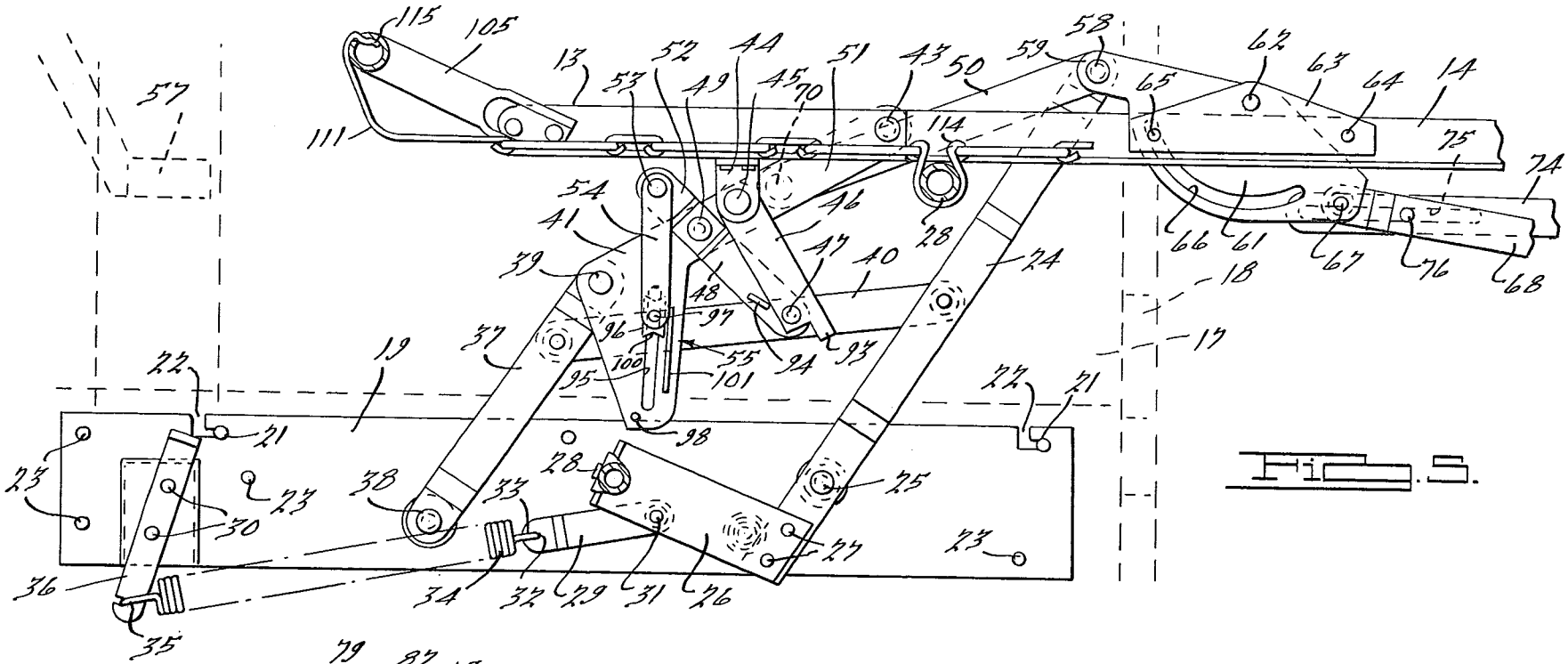
FIG. 5 is an enlarged view in elevation of the structure illustrated in FIG. 2, with parts in bed position relative to the sofa frame.
Figure 6:
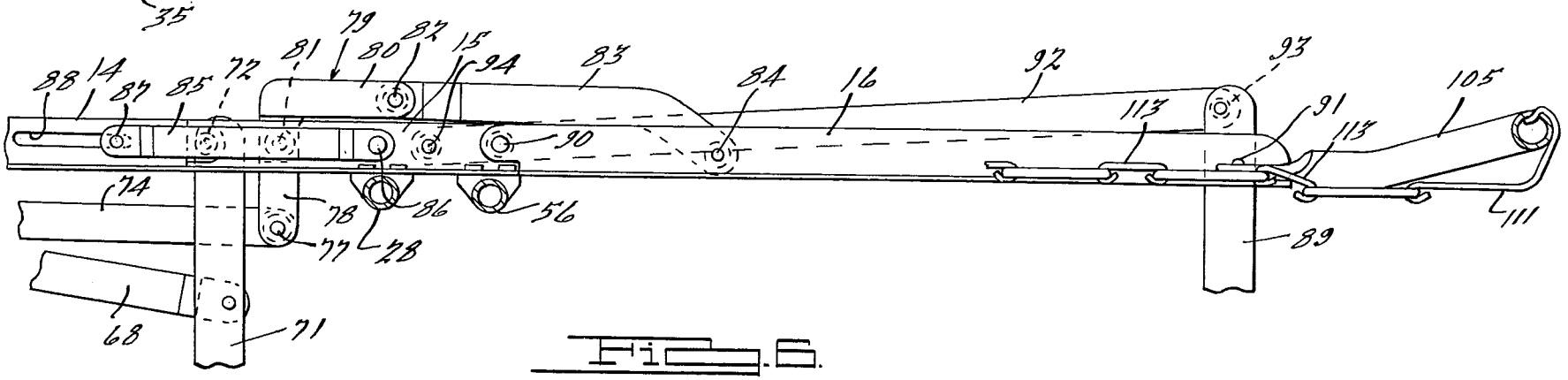
FIG. 6 is a view in elevation of the structure illustrated in FIG. 3, when in raised open bed position to be disposed in extension of the structure illustrated in FIG. 5.
Figure 7:
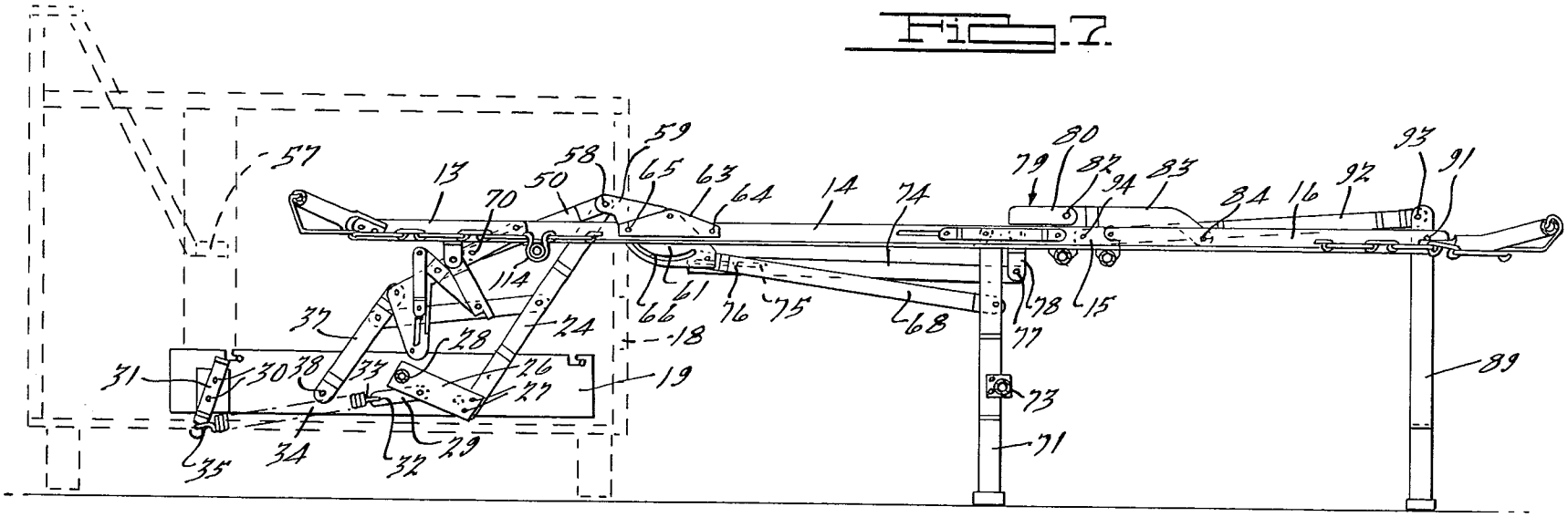
FIG. 7 is a reduced view of the structure illustrated in FIGS. 5 and 6 showing the entire unit in bed position.

Each of the bed sections have side members of angle shape which have tubes 28 extending thereacross and with similar tubes 105 across each of the ends of the bed sections 13 and 16. Sinuous springs 110 are stretched between the side members of the bed sections having a hook 112 at the ends which are secured in holes in the horizontal portion of the side angle members of the bed sections. The springs 110 have links 113 connect the adjacent loops together in hinged relation. Links 114 are employed when the spaced loops are aligned with a cross tube 28 to pass therearound, as illustrated in FIG. 5. Wire extensions 111 are hooked to the endmost loops of the sinuous springs 110 with the outer ends 115 formed to extend within holes in the tubes 105 located across the ends of the end bed sections. The sinuous springs support the weight of the bed occupants when resting on the mattress without too much deflection and permit the sections to roll up into the compact form illustrated in FIG. 4 for storage purpose. It is to be understood that other types of resilient support could be employed for the bed sections. The use of the sinuous spring strips for interconnection by links and stretched across the sides of the bed sections provide a restful deck which deflects a necessary amount when occupied.

What is claimed:

1. In a sofa bed, a sofa frame having a back, sides and a front board which forms a closed storage area, a foldable bed frame received within said area with a TV rear head section extending upwardly within the back storage area and the other sections folded and disposed rearwardly of the front board, the TV rear head section is pivoted to the rear of a rear bottom section which is pivoted to the rear of a vertical intermediate section the front of which is pivoted to a front top section, plates at the inner sides of the sofa frame, an arm pivoted to each said plate at the forward end thereof, a link pivoted to each said plate near the rear end thereof, a bellcrank having the end of one arm secured to the pivot between the TV and rear bottom sections, the other arm of the bellcrank having an extending slot therein, and pivot means joining the bellcrank near the corner between said two arms with the end of said link which is pivoted to said plate.

2. In a sofa bed as recited in claim 1, wherein said plates have L-shaped slots near the ends, and headed elements on said sofa frame sides from which the plates are removable.

3. In a sofa bed as recited in claim 2, wherein a swing plate is pivoted to each side of said rear bottom bed section, and pivot means for securing one end of each said swing plates to the end of said arms which are pivoted to said removable plates.

4. In a sofa bed as recited in claim 3, wherein link means have one end pivoted to the pivot between said swing plates and arms with the opposite end pivoted to the arm of the bellcrank links which are secured to the pivot between the TV bed section and rear bottom section of the bed frame.

5. In a sofa bed as recited in claim 4, wherein a pair of links which are pivoted together at one end has one end of one link pivoted to said bellcrank link arm which is secured to the pivot between the TV rear head section and rear bottom bed section with a free end extending beyond the pivot, a bracket extending downwardly from the TV rear head section, and a pivot securing the end of the other link of said pair to said bracket.

6. In a sofa bed as recited in claim 5, wherein each of the ends of said pair of links which are pivoted together are provided with stop means to prevent the opposite ends from moving into and beyond alignment.

7. In a sofa bed as recited in claim 5, wherein a locking link is pivoted to said free extending end of one of said pair of links, and a releasable mechanism mounted on said locking link which is effective for holding the TV rear head section in a raised angular position.

8. In a sofa bed as recited in claim 7, wherein said releasable mechanism embodies a star wheel which is mounted on the locking link by a pivot which slides within the slot of said other arm of the bellcrank link, the side of a recess in the star wheel being engaged by a pin adjacent to the bottom of said slot for angularly advancing the star wheel into a stop position, and a rib disposed parallel to said slot at the bottom end of which forms the stop for the star wheel for holding said TV rear head section in raised angular position.

9. In a sofa bed as recited in claim 8, wherein the raising of said TV bed section from TV position moves the star wheel downwardly into parallel relation to the rib so that the pivot may move upwardly in said slot moving said star wheel along therewith to permit the TV bed section to move to planar relation with the other bed sections.

10. In a sofa bed as recited in claim 3, wherein a leg is pivoted to each side of the forward portion of the rear bottom section, said pivoted arms on the removable side plates rotating the swing plate to move the link on the opposite end thereof outwardly to swing said legs into floor engaging position with the vertical section extending upwardly and the front top section disposed parallel to the rear bottom section.

11. In a sofa bed as recited in claim 10, wherein a front leg is pivoted at each side of the front bed section, a link engaging each said front leg having one end pivoted to said vertical bed section, the opposite end of each said links being pivoted to the front legs with the pivot out of aligned relation to the pivots of the front legs and the opposite ends of the links, the movement of the front bed section to planar relation to all of the bed sections swinging the front legs into floor engaging position.

12. In a sofa bed as recited in claim 11, wherein spring means are provided on said arms which are pivoted to the removable side plates for balancing the bed sections when moved from horizontal to folded storage position.

* * * * *

UNITED STATES PATENT AND TRADEMARK OFFICE

CERTIFICATE OF CORRECTION

PATENT NO. : 4, 104, 745

DATED : August 8, 1978

INVENTOR(S) : William Pacitti

It is certified that error appears in the above-identified patent and that said Letters Patent are hereby corrected as shown below:

On the title page please insert --Assignee: La-Z-Boy Chair Company--.

Column 2, line 59, "line" should be --link--.
Column 3, line 3, before "41" the word "line" should be --link--;
Column 3, line 7, " line" should be --link--.
Column 4, line 29, "swing" should be --swinging--.
Column 5, line 45, "until" should be --unit--.

Claim 9, line 6, "bed" should be --head--;
Claim 9, line 10, "bed" should be --head--.

Signed and Sealed this

*Twentieth* Day of *February 1979*

[SEAL]

*Attest:*

RUTH C. MASON
*Attesting Officer*

DONALD W. BANNER
*Commissioner of Patents and Trademarks*